US007140557B2

(12) United States Patent
Theron

(10) Patent No.: US 7,140,557 B2
(45) Date of Patent: Nov. 28, 2006

(54) EMITTER TUBE FOR IRRIGATION SYSTEM

(75) Inventor: Christoffel Theron, Nelspruit (ZA)

(73) Assignee: Silkbell Limited, Hong Kong (HK)

( * ) Notice: Subject to any disclaimer, the term of this patent is extended or adjusted under 35 U.S.C. 154(b) by 0 days.

(21) Appl. No.: 10/510,931

(22) PCT Filed: Apr. 9, 2003

(86) PCT No.: PCT/ZA03/00048

§ 371 (c)(1),
(2), (4) Date: May 25, 2005

(87) PCT Pub. No.: WO03/086642

PCT Pub. Date: Oct. 23, 2003

(65) Prior Publication Data

US 2005/0269429 A1 Dec. 8, 2005

(30) Foreign Application Priority Data

Apr. 11, 2002 (ZA) ..... 2002/2848

(51) Int. Cl.
*B05B 3/00* (2006.01)
*B05B 15/06* (2006.01)
*B05B 15/10* (2006.01)

(52) U.S. Cl. ..... 239/229; 239/225.1

(58) Field of Classification Search ..... 239/229, 239/225.1, 200, 207, 227, 450, 461, 542, 239/547

See application file for complete search history.

(56) References Cited

U.S. PATENT DOCUMENTS

| | | | | |
|---|---|---|---|---|
| 199,816 | A | 1/1878 | Fiske | |
| 2,613,993 | A * | 10/1952 | Holden | 239/229 |
| 2,758,874 | A * | 8/1956 | Snyder | 239/229 |
| 3,587,972 | A * | 6/1971 | Weeth | 239/229 |
| 3,633,826 | A * | 1/1972 | Baker | 239/229 |
| 3,840,182 | A * | 10/1974 | Geffroy | 239/145 |
| 4,611,759 | A * | 9/1986 | Cox | 239/229 |
| 4,856,552 | A | 8/1989 | Hiemstra | |
| 4,915,312 | A | 4/1990 | Hiemstra | |
| 6,050,501 | A | 4/2000 | O'Rourke | |

FOREIGN PATENT DOCUMENTS

GB 2-035 933 A 6/1980

* cited by examiner

*Primary Examiner*—Dinh Q. Nguyen
*Assistant Examiner*—Darren Gorman
(74) *Attorney, Agent, or Firm*—The Webb Law Firm

(57) ABSTRACT

The invention provides an emitter tube for an irrigation system, the tube being of resiliently flexible material having a base inlet end adapted to be mounted and a free outlet end adapted to be unmounted, the arrangement being such that, with liquid flowing at a sufficient rate through the emitter tube, hydraulic forces exerted by the flowing liquid on the tube cause the outlet end continuously to move about, further having a base section and an end section downstream from the base section when the end section is of greater flexibility than the base section.

7 Claims, 3 Drawing Sheets

EMITTER TUBE FOR IRRIGATION SYSTEM

BACKGROUND OF THE INVENTION

1. Field of the Invention

THIS invention relates to an emitter tube suitable for an irrigation system.

2. Description of Related Art

The Applicant's U.S. Pat. No. 4,915,312 discloses an irrigation system which includes a sprinker device for liquids comprises an emitter tube of resiliently flexible material having a base inlet end adapted to be mounted and a free outlet end adapted to be un-mounted, the arrangement being such that, with liquid flowing at a sufficient rate through the emitter tube, hydraulic forces exerted by the flowing liquid on the tube cause the outlet end continuously to move about. The emitter tube is mounted on a fitting which has a flow passage there through which leads into the emitter tube, the flow passage having, at its inlet end, a pair of grooves which lead tangentially into the flow passage. These tangentially arranged grooves impart a swirling motion to water entering the emitter tube. A pop-up sprinkler is also disclosed in which the emitter tube is mounted on a plunger which is displaceable in a barrel, the emitter tube protruding through an opening at the end of the barrel.

This system is further disclosed in the Applicant's U.S. Pat. No. 4,856,552 which relates to a flow regulating device suitable for use in the above system.

The specifications of these U.S.A. patents are incorporated into this specification by way of reference. It has been found that the emitter tube which is disclosed in the above United States patents, lends itself to advantageous modifications for certain applications.

For example, in certain applications a greater radius of throw of irrigation water is desirable and it has been found that the emitter tube can be modified to achieve such a results.

Also for example a more even water distribution with a single sprinkler as well as water distribution with sprinklers laid out on the standard group spacing could be achieved by modifying the emitter tube. Further for example where the size of the droplets of irrigation water is to be controlled, the emitter tube could likewise be modified to achieve such a result.

SUMMARY OF THE INVENTION

It is accordingly an object of the present invention to provide a novel emitter tube of the type disclosed in the above United States patents wherein the frequency of oscillation of the tube in use is reduced for a given specific flow rate.

A further object of the invention is to provide an emitter tube having a greater radius of throw of irrigation water.

A further object of the invention is to provide a sprinkler system having an improved distribution with a single sprinkler, as well as an improved water distribution with sprinklers laid out on standard grid spacings.

A further object of the invention is to provide an emitter tube which is capable of producing droplets of irrigation liquid of a controlled size.

A resiliently flexible emitter tube of the type described in U.S. Pat. No. 4,915,312 having a base section and an end section downstream from the base section wherein the end section is of greater flexibility than the base section.

In one arrangement the emitter tube is characterized in that a base section of the emitter tube has a wall thickness which is greater than the end section of the tube. Preferably the wall thickness of the tube will taper evenly from the base thereof towards the free end thereof. Alternatively, the wall thickness of the emitter tube could be stepped at one or more intervals along its length so as progressively to reduce in wall thickness.

In a further embodiment of the invention the emitter tube will comprise an end section, an intermediate section and a base section, and the arrangement will be one wherein the intermediate section is of greater flexibility than the base section and the end section is in turn of greater flexibility than the intermediate section. In this arrangement the intermediate section could thus define a waist portion of reduced diameter.

In one embodiment in accordance with the invention the inner diameter of the tube could remain substantially constant, while the outer profile of the tube will reduce in wall thickness from the base thereof towards the free end thereof.

Thus in one example where the tube has length of 177 mm, the outer diameter thereof at the base could be 10 mm, and the outer diameter thereof at the free end could be 6 mm, with the tube tapering evenly between the base and free end. The inner diameter of the tube could be 5 mm in the above case. These dimensions could vary widely and the invention is in no way limited in this regard.

A further alternative provides for the inner passage of the tube to taper outwardly from a larger diameter at the base to a smaller diameter at the end thereof.

BRIEF DESCRIPTION OF THE DRAWINGS

A further features of the invention will appear from the preferred embodiment which is described below purely by way of example with reference to the accompanying drawing wherein.

DETAILED DESCRIPTION OF THE PREFERRED EMBODIMENTS

Figure 1:
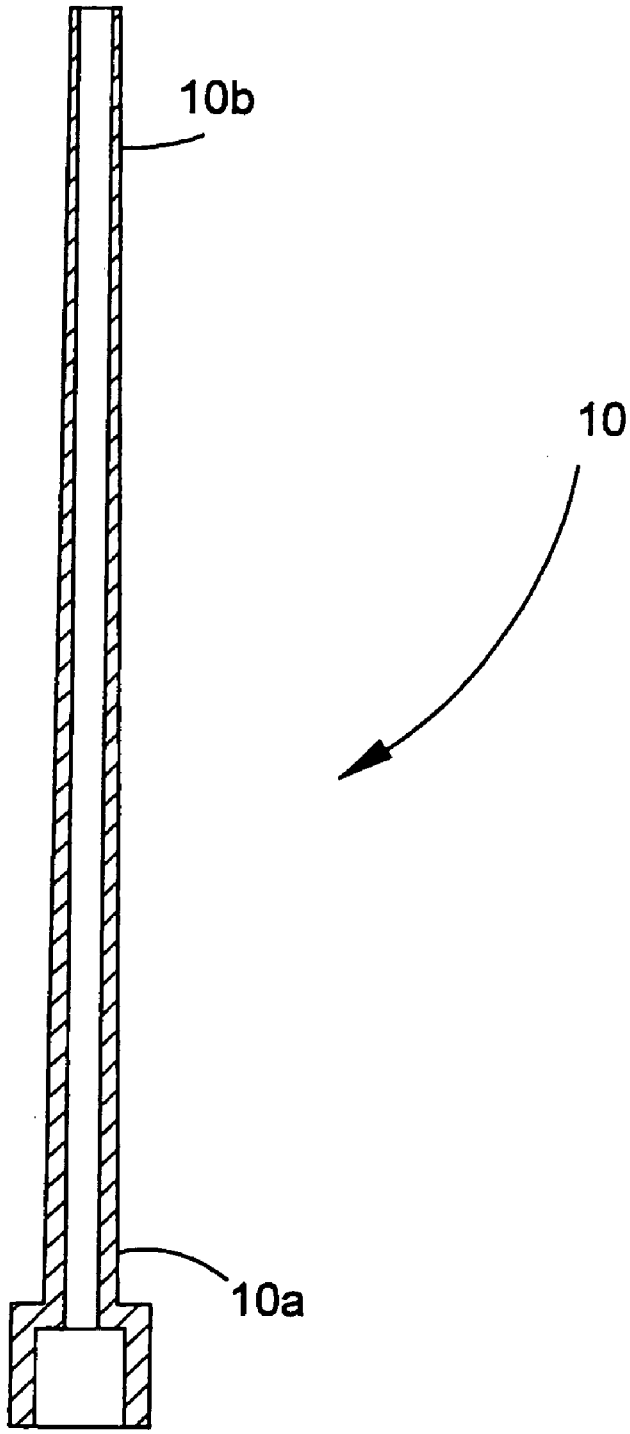
FIG. 1 is a schematic sectioned elevation of an emitter tube arrangement in accordance with the invention.

U.S. Pat. No. 4,915,312 which is referred to above and discloses an irrigation system which includes a sprinkling device for liquids comprises an emitter tube 10 of resiliently flexible material having a mounted base 10*a* and an unmounted outlet end 10*b*, the arrangement being such that, with liquid flowing at a sufficient rate through the emitter tube 10, hydraulic forces exerted by the flowing liquid on the tube cause the outlet end 10*b* continuously to move about. The emitter tube is mounted on a fitting which has a flow passage there through which leads into the emitter tube, the flow passage having, at its inlet end, a pair of grooves which lead tangentially into the flow passage. These tangentially arranged grooves impart a swirling motion to water entering the emitter tube. A pop-up sprinkler is also disclosed in which the emitter tube is mounted on a plunger which is displaceable in a barrel, the emitter tube protruding through an opening at the end of the barrel.

The emitter tube 10 is designed to perform a whiplash-type of action in vertical planes while rotating about its vertical axis. The tube 10 will thus move to and fro in a vertical plane which is continually rotating as a result of rotational action of the water stream within the tube 10. The emitter tube 10 of the present invention is designed to operate with an increased internal water pressure, and thus velocity while limiting the frequency of the oscillating to and fro whiplash-type movements of the emitter tube 10. In this way, a greater distance of throw is obtained with the emitter tube 10 of the invention relative to a prior art emitter tube as disclosed in the above United States patent.

With reference to the drawings, the current invention teaches an emitter tube 10 for use in such irrigation systems which is characterised in that a base zone 10*a* of the emitter tube 10 is provided with a greater wall thickness than the tube 10 towards the free end 10*b* thereof. Thus in the arrangement illustrated, the wall thickness of the emitter tube 10 tapers evenly from a relatively thick base zone 10*a* to a relatively thin free end 10*b*.

The above arrangement results in less flexibility at the base section 10*a* of the tube to permit the use of higher irrigation water pressures, without an increase in the frequency of oscillation of the tube 10 in use.

In the arrangement shown, the inner diameter of the tube remains constant while the outer profile is tapered as described above. In this case, the total length the tube is 177 mm, and the wall thickness at the base 10*a* thereof is in the order of 3 mm, and tapers evenly to a wall thickness at the extremity of the tube which is in the order of 0.5 mm. It has been found that many variations of the arrangement above are possible. For example, in certain instances, not shown, the inside diameter of the tube 10 could taper from a relatively large diameter at the base thereof to a smaller diameter at the free end thereof, while the outer profile of the tube could be of constant wall thickness, or also tapered to provide a desired result.

In a further alternative, not shown, the tube 10 could be stepped at intervals along its length so as to reduce in wall thickness from the base 10*a* to the free end 10*b* thereof.

Figure 3:
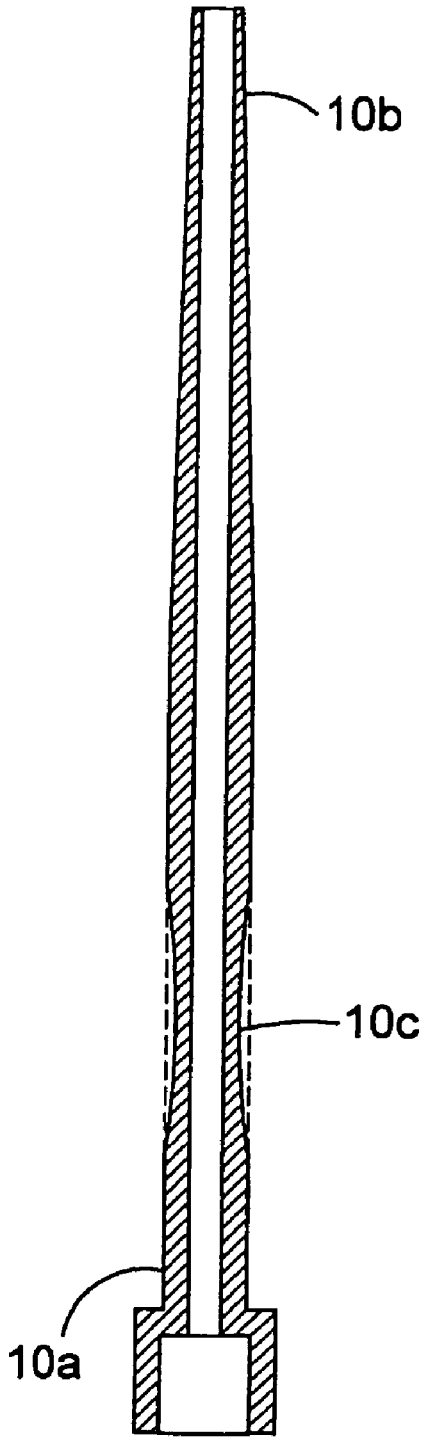
FIG. 3 is a schematic section elevation of a different embodiment of the emitter tube in FIG. 1.

In a further alternative arrangement shown schematically in FIG. 3, wherein an intermediate section 10*c* of the tube which is disposed between the end section 10*b* and the base section 10*a* of the tube 10 is provided with a reduced wall thickness. This renders the intermediate section 10*c* of the tube more flexible to induce flexing of the tube in this section 10*c* in use. The end section 10*b* of the tube will likewise be flexible to perform a whiplash-type of action during oscillation of the tube 10. This tube therefore mimics the actual whiplash-type of movement of a prior art tube, in a controlled fashion. Thus the length and flexibility of the intermediate section 10*c* and the end section 10*b* can be pre-selected to give a predetermined performance. For example by varying the flexibility of the intermediate section 10*c*, the frequency of oscillation can be varied.

Figure 2:
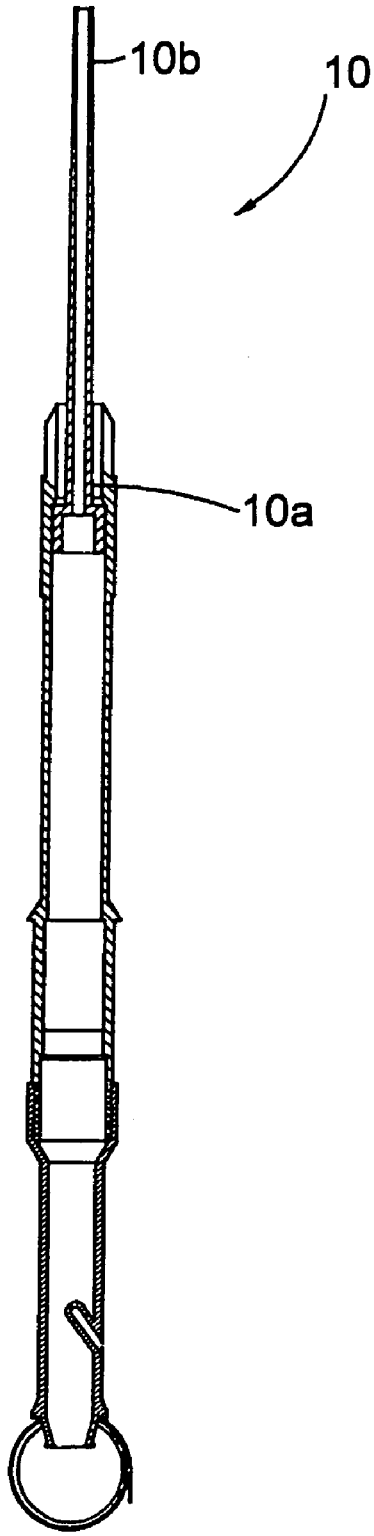
FIG. 2 is a schematic sectioned elevation of an irrigation lead including the emitter tube of FIG. 1.

It has been found that with the tube 10 described above, one or more of the following benefits will accrue:

1. An increased radius of throw has been experienced with a more uniform water distribution. It has been found that because the emitter tube 10 is relatively rigid, it resists flexing thus reducing oscillating speed and maintaining larger droplet sizes for a further throw of irrigation water.
2. With such an increase in the radius of throw, a reduction of the infield infrastructure accrues and results in a reduction in the cost of this system.
3. The expected improved distribution renders the use of the sprinkler head shown in FIG. 2, possible on a low riser.
4. The wall thickness of the tube 10 minimizes the possibility of blow-outs caused by excess air during the start up of this system. A blow out normally occurs when there is excessive air in the system that cannot escape fast enough and the tube 10 is then inflated causing damage thereto.
5. The expected increase in the radius of throw allows for wider spacings on low risers further reducing costs. In a irrigation system, the spacings between irrigation heads, FIG. 2, of 12×12 meters or 12×14 meters on a low riser (60 to 90 cm) are possible. The spacings of 15×15 meters on tall risers could be achieved.
6. Reduction in labour costs results due to the fact that less equipment is required to be moved during the harvest of some crops.
7. A reduction in labour cost also results due to the fact that less equipment may be required to be moved on a movable system.
8. New applications for the sprinkler shown in FIG. 2 are possible, for example used as Side rolls on irrigation machines.
9. A system utilising the emitter in FIG. 1 should exhibit better wind resistance due to larger droplets with a higher velocity.
10. With the emitter tube in FIG. 1, a curved droplet trajectory is achieved reducing dry areas behind obstacles such as trees.

Clearly many variations of the tube are possible as mentioned above without departing from the principles set out in the consistory clauses.

The invention claimed is:

1. An emitter tube suitable for an irrigation system, said tube formed from a resiliently flexible material including a base inlet end adapted to be mounted and a free outlet end adapted to be un-mounted, said tube further including a base section adjacent to the base inlet end and an end section downstream from said base section, an inner diameter of the emitter tube is substantially constant, while an outer diameter of the emitter tube tapers evenly from the base section to the outlet end, wherein said end section has greater flexibility than said base section; and wherein, with a liquid flowing at a sufficient rate through said emitter tube, hydraulic forces exerted by the flowing liquid on said emitter tube cause said outlet end to move continuously.

2. The emitter tube according to claim 1, wherein said base section of said emitter tube has a wall thickness which is greater than a wall thickness of said end section.

3. The emitter tube according to claim 1, further comprising:

an intermediate section disposed between the base section and the end section, wherein said intermediate section is of greater flexibility than said base section.

4. The emitter tube according to claim 3, wherein said end section has greater flexibility than said intermediate section.

5. The emitter tube according to claim 1, wherein the outer profile of said emitter tube reduces in wall thickness from said base section towards said outlet end.

6. The emitter tube according to claim 1, wherein said tube has an overall length of approximately 177 mm, an outer diameter at said base inlet end of approximately 10 mm, and an outer diameter at said outlet end of approximately 6 mm.

7. The emitter tube according to claim 6, wherein the inner diameter of said emitter tube is an approximately constant 5 mm along the length of said emitter tube.

* * * * *